US009650999B2

(12) United States Patent
Ferlay et al.

(10) Patent No.: US 9,650,999 B2
(45) Date of Patent: May 16, 2017

(54) RECIRCULATED EXHAUST GASES DISTRIBUTION DEVICE, CORRESPONDING INLET MANIFOLD AND CORRESPONDING INLET MODULE

(71) Applicant: VALEO SYSTEMES THERMIQUES, Le Mesnil Saint-Denis (FR)

(72) Inventors: Benjamin Ferlay, Cernay-la-Ville (FR); Jean-Pierre Galland, Les Essarts-le-Roi (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 10 days.

(21) Appl. No.: 14/563,319

(22) Filed: Dec. 8, 2014

(65) Prior Publication Data

US 2015/0159590 A1 Jun. 11, 2015

(30) Foreign Application Priority Data

Dec. 9, 2013 (FR) ..... 13 62279

(51) Int. Cl.

| | |
|---|---|
| ***F02M 25/07*** | (2006.01) |
| ***F02M 35/10*** | (2006.01) |
| ***F02M 26/12*** | (2016.01) |
| ***F02M 26/09*** | (2016.01) |
| ***F02M 26/19*** | (2016.01) |
| ***F02M 26/21*** | (2016.01) |

(Continued)

(52) U.S. Cl.

CPC ..... *F02M 25/0712* (2013.01); *F02M 26/09* (2016.02); *F02M 26/12* (2016.02); *F02M 26/19* (2016.02); *F02M 26/21* (2016.02); *F02M 26/27* (2016.02); *F02M 26/70* (2016.02); *F02M 35/10222* (2013.01); *F02M 35/10268* (2013.01)

(58) Field of Classification Search

CPC ..... F02M 26/19; F02M 26/21; F02M 26/01; F02M 26/20; F02M 26/02; F02M 26/10; F02M 26/14; F02M 26/38; F02M 35/10124; F02M 35/10262

USPC ..... 123/568.11–568.32

See application file for complete search history.

(56) References Cited

U.S. PATENT DOCUMENTS 7,527,088 B2 * 5/2009 Hayashi ..... F01N 5/02 165/159

2004/0237931 A1 * 12/2004 Okamoto ..... F02B 27/0284 123/308

(Continued)

*Primary Examiner* — Long T Tran

(74) *Attorney, Agent, or Firm* — Howard & Howard Attorneys PLLC

(57) ABSTRACT

Disclosed is a recirculated exhaust gases distribution device (11) of an inlet manifold (3) for an air inlet module configured to supply at least one internal combustion engine cylinder with a flow of air containing inlet gases and/or recirculated exhaust gases (EGR gases), the distribution device (11) including a recirculated exhaust gases distribution duct (13), the distribution duct (13) including first means (15) for injection of recirculated exhaust gases into the flow of air for supplying at least one cylinder. The distribution device (11) further includes a control member (17) that is arranged in the distribution duct (13) and is configured to modulate the flow of recirculated exhaust gases injected by the first injection means (15).

11 Claims, 3 Drawing Sheets

(51) Int. Cl.
*F02M 26/27* (2016.01)
*F02M 26/70* (2016.01)

(56) References Cited

U.S. PATENT DOCUMENTS

2007/0063164 A1* 3/2007 Torii ..... F02D 9/106
251/308
2009/0283076 A1* 11/2009 Aoki ..... F02D 9/101
123/568.11
2012/0090581 A1* 4/2012 De Almeida ..... F02M 25/0722
123/568.11
2012/0304970 A1* 12/2012 Schlemmer-
Kelling ..... F02M 35/10222
123/568.12

* cited by examiner

RECIRCULATED EXHAUST GASES DISTRIBUTION DEVICE, CORRESPONDING INLET MANIFOLD AND CORRESPONDING INLET MODULE

CROSS-REFERENCE TO RELATED APPLICATIONS

This application claims priority to and all the advantages of French Patent Application No. FR 1362279, filed on Dec. 9, 2013, the content of which is incorporated herein by reference.

The present invention concerns the general field of the supply of air to motor vehicle engines, and more particularly engines in which the air supply comes from a compressor or a turbocompressor. The invention is more particularly aimed at multi-cylinder engines and the devices used to distribute the flows of recirculated exhaust gases to the cylinders.

BACKGROUND

The engines to which the invention relates may be spark-ignition engines or compression-ignition (diesel) engines. The engines may be supercharged or aspirated.

A motor vehicle internal combustion engine includes a combustion chamber, generally formed by a plurality of cylinders, in which a mixture of fuel and oxidant is burned to generate the work of the engine. The gases admitted into the combustion chamber are called inlet gases. They include air called charge air when it comes from a compressor.

In order to increase the density of the charge air, these gases are generally cooled before being introduced into the combustion chamber. This is done by a heat exchanger also known as a charge air cooler (CAC).

To reduce polluting emissions it is known to introduce so-called "recirculated" exhaust gases into the inlet gas flow, a process known to the person skilled in the art as exhaust gas recirculation (EGR). These are exhaust gases bled off on the downstream side of the combustion chamber to be rerouted (recirculated) to the inlet gas flow, on the upstream side of the combustion chamber, where they are mixed with the charge air for their admission into the combustion chamber.

In order to admit into the engine block of a motor vehicle internal combustion engine a charge air flow including an inlet gas flow, that is to say a cool air flow, and/or a recirculated exhaust gas flow, an inlet manifold intended to be mounted on the engine block enables optional mixing of the cool air flow and the recirculated exhaust gas flow and distribution of the mixture into the engine block.

In this case, means are provided for routing recirculated exhaust gases into the inlet manifold enabling the distributed injection of the recirculated exhaust gases into the charge air flow.

In accordance with one known solution, the recirculated exhaust gases (EGR gases) are introduced into the inlet manifold via a distribution duct arranged transversely to the charge air flow, discharging for example on the downstream side of the charge air cooler and including a few injection holes that enable the recirculated exhaust gas to flow into the volume of the inlet manifold.

The recirculated exhaust gases are able to mix with the inlet gases coming for example from the charge air cooler. The mixture is then directed toward the outlet ducts to feed the cylinder(s) of the engine.

However, the size and the position of the injection holes are fixed. In fact, the size and the disposition of the holes are predefined for a certain range of operation of the engine and cannot be modified while the engine is operating.

By way of example, injection holes having a certain diameter enable a satisfactory exhaust gas level to be obtained in the cylinders for an engine speed of around 1 250 rpm. However, with this same diameter the recirculated exhaust gas level in the cylinders is not satisfactory for an engine speed around 2 000 rpm. The converse is equally valid.

In conclusion, it is necessary to choose a size that is suitable for one engine speed range but not for the others. This leads to an optimum distribution limited to a narrow range of operation of the engine.

SUMMARY OF THE INVENTION

To this end, the invention consists in a recirculated exhaust gases distribution device of an inlet manifold for an air inlet module configured to supply at least one internal combustion engine cylinder with a flow of air containing inlet gases and/or recirculated exhaust gases, the distribution device including a recirculated exhaust gases distribution duct, the distribution duct including first means for injection of recirculated exhaust gases into the flow of air for supplying at least one cylinder, characterized in that the distribution device further includes a control member arranged in the distribution duct and configured to modulate the flow of recirculated exhaust gases injected by the first injection means.

Such a distribution device enables optimization of the recirculated exhaust gases distribution for a plurality of operating points of the engine, for example for an engine speed range of the order of 1 250 rpm to 2 500 rpm.

In fact, the control member enables active modulation of the recirculated exhaust gases flow injected into the charge air flow by modifying the flow section of the recirculated exhaust gases flow injected by the first injection means into the charge air flow, notably as a function of the engine conditions.

In accordance with one embodiment, the control member is a rotary control member configured to modulate the recirculated exhaust gases flow as a function of the angular position of the rotary control member. For example, it may be a rotary gate or a rotary flap, such as a butterfly type flap.

In accordance with a variant embodiment, the control member is mobile in translation. For example, it may be a guillotine type flap mobile in translation.

In accordance with one aspect of the invention, the first injection means include at least one first injection hole and the control member is conformed so as to adjust the dimensions of the first injection hole.

The control member enables variation of the size or dimension of the first injection holes as a function of the engine speed and consequently enables precise exhaust gas distribution in accordance with different engine conditions.

With such a control member, it is also possible to block the first injection holes completely and therefore to prevent any flow of recirculated exhaust gases in the cool air path.

It is then possible to eliminate the exhaust gas distribution valve found in the prior art solutions enabling metering of the exhaust gas introduced into the distribution duct. It is therefore no longer necessary to provide at the level of the inlet manifold an interface to connect the distribution duct to such a valve. This results in a cost reduction.

Said distribution device may further include one or more of the following features, separately or in combination:

the control member includes second recirculated exhaust gases injection means including at least one second injection hole and the control member is adapted to be arranged in a position allowing fluidic communication to be established between a first injection hole and an associated second injection hole, the control member being a rotary gate, for example, the number of second injection holes of the control member is the same as the number of first injection holes, the distribution duct is adapted to be arranged substantially transversely relative to the flow of the flow of air in the inlet module, the control member is adapted to be arranged substantially transversely relative to the flow of the flow of air in the inlet module, the control member takes the form of a substantially cylindrical tube, such as a gate, said device includes at least one return means adapted to urge the control member toward a predefined safety position, for example a return spring.

The invention also concerns an inlet manifold for an air inlet module configured to supply at least one internal combustion engine cylinder with a flow of air containing inlet gases and/or recirculated exhaust gases, characterized in that it includes at least one device as defined above for distribution of recirculated exhaust gases.

The invention further concerns air inlet module, such as a charge air inlet module, configured to supply at least one internal combustion engine cylinder with a flow of air, such as charge air, containing inlet gases and/or recirculated exhaust gases (EGR gases), characterized in that it includes at least one recirculated exhaust gases distribution device as defined above.

In accordance with one embodiment the air inlet module includes a heat exchanger configured to condition the flow of air and an inlet manifold configured to supply at least one cylinder of the engine, arranged downstream of the heat exchanger in the direction of flow of the flow of air in the inlet module. The recirculated exhaust gases distribution device is arranged downstream of the heat exchanger, on a part on the upstream side of the inlet manifold, relative to the direction of flow of the flow of air in the inlet module.

BRIEF DESCRIPTION OF THE DRAWINGS

Other advantages and features will become apparent on reading the description of one nonlimiting illustrative example of the present invention, and from the appended drawings, in which.

In these figures, substantially identical elements bear the same references.

DETAILED DESCRIPTION

Figure 1:
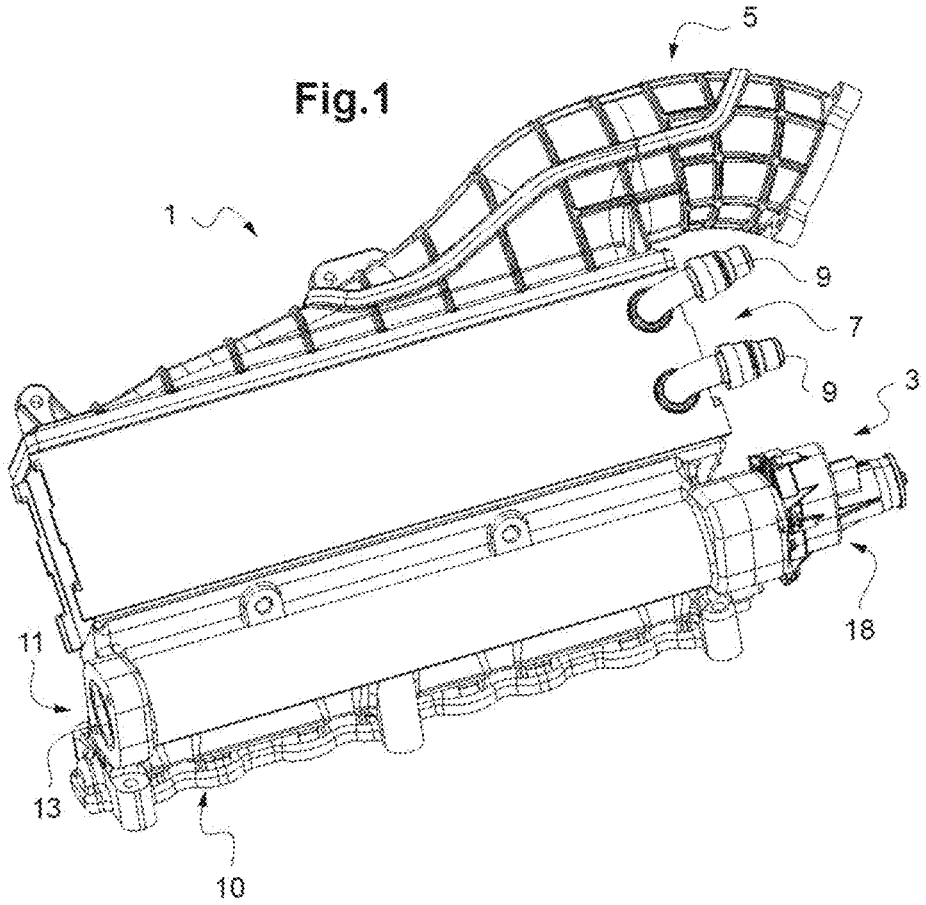
FIG. 1 shows an air inlet module equipped with an exhaust gas distribution device in accordance with the invention.

There is shown in FIG. 1 an inlet module 1 intended to be placed on the engine block of a multi-cylinder engine (not represented in the figures) and that includes for each cylinder of the engine at least one conduit intended to extend into the engine block to supply the cylinder with inlet gas.

The inlet module 1 includes an inlet manifold 3, also called the distribution manifold, into which the engine cylinder supply pipe(s) open(s).

The engine being a multi-cylinder engine in the example shown, the inlet collector 3 is configured to distribute the inlet gas flows between the conduits associated with a respective cylinder of the engine.

The inlet module 1 further includes an entry manifold 5 for supplying the inlet manifold 3 with inlet gas.

The inlet module 1 may include a heat exchanger 7 that the inlet gases coming from the entry manifold 5 pass through before being distributed into the supply conduits of the various cylinders. The heat exchanger 7 is configured to cool the charge air. Such a heat exchanger 7 is generally referred to as a charge air cooler (CAC). Such a heat exchanger 7 may include a bundle of tubes or plates (not represented) delimiting ducts for the circulation of a fluid, such as the cooling liquid, and having at least one inlet and outlet tube 9 for the cooling liquid.

Hereinafter, the terms "upstream" and "downstream" are defined relative to the direction of circulation of the charge air in the inlet module 1. In accordance with the embodiment shown in FIG. 1, the charge air is introduced into the heat exchanger 7 via the entry manifold 5, mounted on the upstream side of the heat exchanger 7, and evacuated via the inlet manifold 3, also known as the distribution manifold, mounted on the downstream side of the heat exchanger 7 and intended to be connected to the engine block (not represented).

Inlet Manifold

As for the inlet manifold 3, it enables distributed admission of the inlet gases and/or recirculated exhaust gases into the engine cylinders.

The inlet manifold 3 is made of metal for example and can be mounted on the engine block (not represented).

In order to allow the admission of charge air, optionally cooled, into each of the engine cylinders (not represented), the inlet manifold 3 includes at least one outlet duct 10 forming a flow section for the charge air. Here charge air means cool air possibly mixed with exhaust gases recovered from the engine outlet.

In accordance with the example shown, the inlet manifold 3, mounted on the downstream side of the heat exchanger 7, includes an open upstream part onto which leads the outlet face of the bundle of the heat exchanger 7 and a downstream part intended to be fixed to the engine block. The part downstream of the inlet manifold 3 here includes the outlet duct(s) 10 adapted to open into the respective inlet cylinders of the engine.

The inlet manifold 3 further includes a recirculated exhaust gases distribution device 11.

In accordance with the example shown, the distribution device 11 is in the part upstream of the inlet manifold 3.

The distribution device 11 enables injection of recirculated exhaust gases into the charge air flow.

Figure 2:
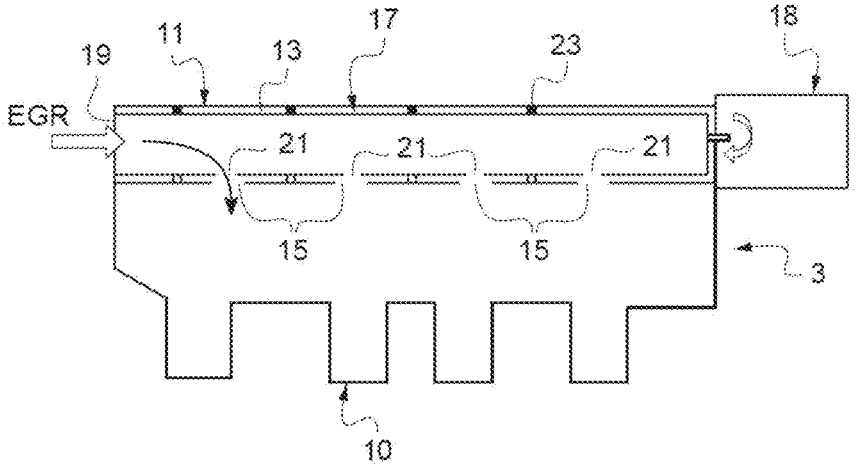
FIG. 2 is a diagrammatic view representing an inlet manifold of the inlet module from FIG. 1, including an exhaust gas distribution device.

To this end, referring to FIG. 2, the distribution device 11 includes an exhaust gas distribution duct 13 and first exhaust gas injection means 15, such as at least one first injection hole 15, enabling fluidic communication to be established between the distribution duct 13 and the outlet duct(s) 10 for supplying the cylinders.

The distribution duct 13 is on the part upstream of the inlet manifold 3. In the example shown in FIGS. 2 and 3 the distribution duct 13 faces the outlet of the heat exchanger 7 and is substantially transverse to the direction of flow of the charge air.

Here the distribution duct 13 extends the full width of the inlet manifold 3.

It may be a distribution duct 13 of substantially cylindrical shape.

For their part the first injection hole(s) 15 are for example made in a downstream wall of the distribution duct 13 relative to the direction of flow of the charge air.

In accordance with the example shown, the distribution duct 13 includes a series of first injection holes 15, here four first injection holes 15.

The first injection holes 15 are substantially circular, for example. They could equally be oval or of any other appropriate shape.

Of course, the inlet manifold 3 may include a different number of first injection holes 15. Moreover, in accordance with a variant embodiment the shape or the dimensions of the first injection holes 15 may be different.

The distribution device 11 further includes a control member 17 configured to modulate the recirculated exhaust gases flow that is injected by the first injection means 15.

To this end, the control member 17 is conformed here so as to vary the dimensions of the first injection holes 15. In particular, in the case of first injection holes 15 of substantially circular shape, the control member 17 is conformed so as to adjust the diameter of the first injection holes 15.

The dimensions, in particular the diameter, of the first injection holes 15 are linked to the engine speed. In other words, the control member makes it possible to adjust the dimensions of the first injection holes 15 as a function of the engine speed.

The control member 17 may be driven by an actuator 18 that may be electrical or alternatively pneumatic. Using an electrical actuator 18, it is possible to provide continuous fine adjustment of the position, for example the angular position, of the control member 17 with a movement of very small amplitude. Using a pneumatic actuator 18, there may for example be provided a predefined number of angular positions of the control member 17.

Alternatively, the control member 17 may be driven by the engine shaft.

Moreover, in order to avoid soiling of the distribution device 11, there may be provision for actuating the control member 17 rapidly several times so as to dislodge pollutants.

The control member 17 is a rotary control member, for example. It is therefore as a function of the angular position of the rotary control member 17 that the dimensions of the first injection holes 15 may be adjusted.

In accordance with an alternative that is not represented, the control member 17 is mobile in translation. For example, a regulation flap mobile in translation may be provided such as a guillotine type flap.

Figure 3:
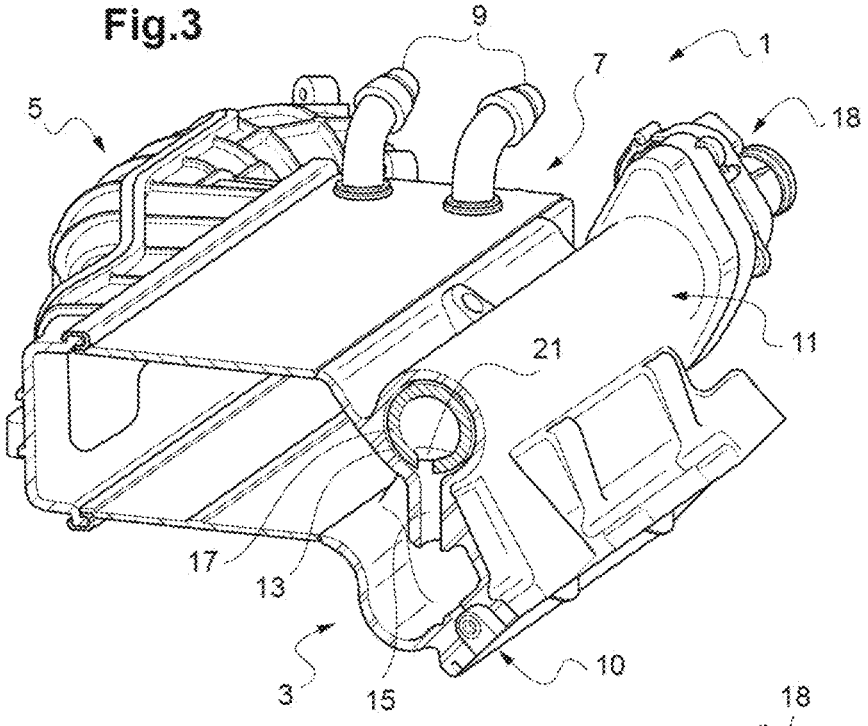
FIG. 3 is a sectional view of the inlet module.

In accordance with the embodiment shown in FIGS. 2 and 3, the control member 17 takes the form of a substantially cylindrical rotary tube called a gate. Alternatively a rotary control member could be provided, such as a rotary flap, for example a butterfly type flap.

The gate 17 is configured to turn about its longitudinal axis.

The gate 17 can be disposed so that its longitudinal axis is arranged substantially transversely relative to the direction of flow of the charge air.

The gate 17 is arranged in the distribution duct 13 so as to face the outlet from the heat exchanger 7, substantially transversely to the direction of flow of the charge air. The gate 17 can extend the whole length of the distribution duct 13 and therefore here the total width of the inlet manifold 3.

Referring again to FIG. 2, here the gate 17 includes a recirculated exhaust gases entry orifice 19 into the gate 17. The introduction of the exhaust gases into the gate 17 is diagrammatically represented by the arrow EGR in FIG. 2.

The gate 17 is conformed so as to allow or to block the circulation of the recirculated exhaust gases, but also to modulate the exhaust gas flow, notably by adjusting the flow section of the first injection holes 15, as a function of the angular position of the gate 17.

To this end, the gate 17 includes second injection means 21, such as at least one second injection hole 21.

The second injection means 21 are conformed so as to be able to vary/adjust the flow section of the recirculated exhaust gases flow via the first injection means 15.

In accordance with the embodiment shown, the gate 17 includes a series of second injection holes 21, to be more precise the same number of holes as the first injection holes 15, here four.

Figure 4:
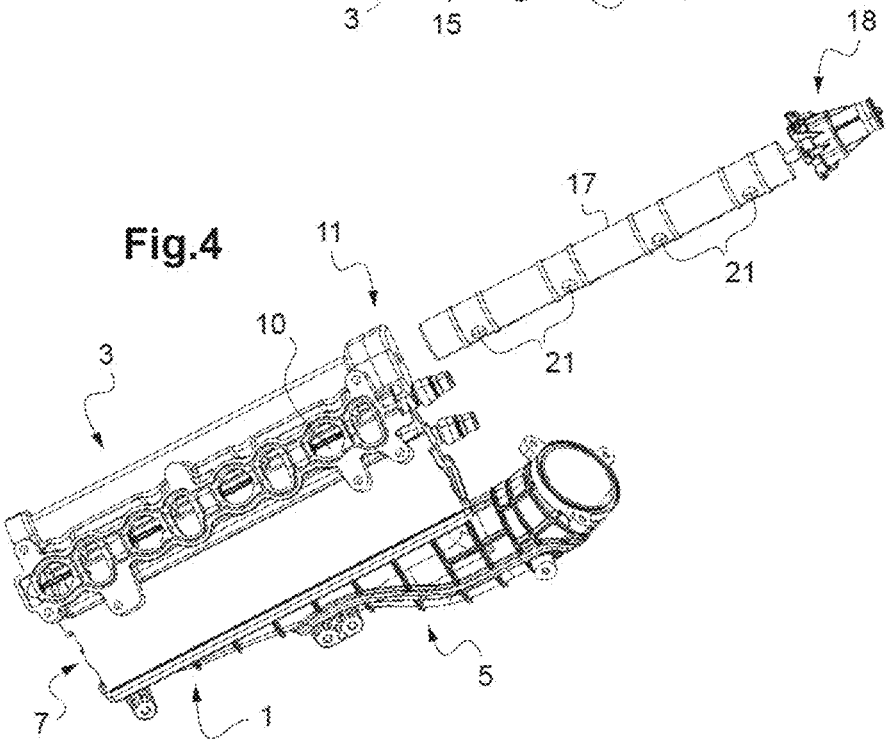
FIG. 4 is an exploded view of the inlet manifold and an exhaust gas flows rotary control member.

In accordance with the embodiment shown in FIGS. 2 and 4, the gate 17 has the series of second injection holes 21 on the same side, four holes in the example shown.

When they are at least partly facing the first injection holes 15, the second injection holes 21 enable injection of the exhaust gases into the flow of charge air.

In fact, the gate 17 can be arranged in a position enabling fluidic communication to be established between a first injection hole 15 and an associated second injection hole 21.

To be more precise, each second injection hole 21 is arranged on the gate 17 so that it can be aligned with an associated first injection hole 15 as a function of the position of the gate 17, as shown in FIGS. 2 and 3, that is to say so that the associated first and second injection holes 15, 21 are face-to-face to allow the passage of an exhaust gas flow. When a second injection hole 21 is aligned with an associated first injection hole 15 the flow section for the recirculated exhaust gases flow is at a maximum.

In accordance with the example shown in FIG. 4, the second injection holes 21 have a substantially circular shape.

Of course, the number of second injection holes 21 may vary. A different shape or different dimensions of the second injection holes may also be provided. A different distribution of the second injection holes 21 on the gate 17 may also be provided. In particular, the second injection holes 21 need not be aligned with one another.

The injection of the exhaust gases is distributed thanks to the distribution of the first injection holes 15 along the distribution duct 13 and the distribution of the second injection holes 21 along the gate 17.

Accordingly, in the volume of the inlet manifold 3 downstream of the gate 17 relative to the direction of flow of the charge air, the inlet gases admitted via the front face of the inlet manifold 3 are mixed with the recirculated exhaust gases admitted via the distribution device 11.

The charge air consisting of cool air possibly mixed with recirculated exhaust gases is then distributed into the outlet ducts 10 in order to supply the cylinders of the engine with gases for combustion.

Moreover, referring again to FIG. 2, the distribution device 11 may further include at least one sealing means 23 arranged so as to prevent a flow of recirculated exhaust gases injected via a second injection hole 21 recirculating toward another second injection hole 21 of the gate 17 instead of circulating in the volume of the inlet manifold 3 to be directed toward the outlet ducts 10.

Moreover, in accordance with an embodiment that is not shown, there may be provided at least one return means, such as a return spring, adapted to urge the gate 17 toward a predefined safety position, for example in the event of a malfunction of the actuator 18. By way of nonlimiting example, this predefined position may be such that the second injection holes 21 of the gate 17 coincide with the first injection holes 15 of the distribution duct 13 or to the contrary so that the second injection holes 21 of the gate 17 are not aligned with the first injection holes 15 of the distribution duct 13.

Accordingly, the distribution device 11 enables active distribution of the recirculated exhaust gases, in other words enables active adaptation of the flows of recirculated exhaust gases via the first injection means 15 in accordance with the flow rate of the recirculated exhaust gases reaching the gas entry orifice 9.

In fact, with such a distribution device 11, the flow section of the flows of recirculated exhaust gases may be adjusted as a function of the speed or the flow rate of the recirculated exhaust gases.

By way of illustrative and nonlimiting example, in the case of a low flow rate of the recirculated exhaust gases, the gas flow section defined by the first injection hole 15 nearest the gas entry orifice 19 may be reduced so as to force the exhaust gas toward the other first injection holes 15 farther from the gas entry orifice 19. In other words, in the case of a low flow rate of the recirculated exhaust gases, the first injection hole 15 must have a smaller diameter relative to the other first injection holes 15. To this end, in the case of a rotary gate 17, the gate 17 is turned into a corresponding angular position In contrast, in the case of a high flow rate of the recirculated exhaust gases, there is a risk that the first injection hole 15 nearest the gas entry orifice 19 may be bypassed, the exhaust gas circulating instead toward the injection holes 15 farther from the gas entry orifice 19. In this case, the gas flow section defined by the first injection hole 15 nearest the gas entry orifice 19 may be increased so as to force the exhaust gas to pass through this first injection hole 15 nearest the gas entry orifice 19. In other words, in the case of a high flow rate of the recirculated exhaust gases, the first injection hole 15 must have a greater diameter relative to the other first injection holes 15. To this end, in the case of a rotary gate 17, the gate 17 is turned into a corresponding angular position.

By modulating the exhaust gas flow section in this way, it is possible to obtain an exhaust gas level in the cylinder that is satisfactory for a plurality of operating points of the engine.

A computer in the vehicle can for example detect the flow rate of the recirculated exhaust gases and send a corresponding set point to the actuator 18 to drive the control member 17 into the appropriate position for varying the diameter of the first injection holes 15.

There is obtained in this way a distribution of the recirculated exhaust gases appropriate for a range of engine speeds, for example of the order of 1 250 rpm to 2 500 rpm, that is wider than for the prior art solutions enabling passive distribution of the exhaust gases, that is to say without adaptation of the recirculated exhaust gas flow section.

Finally, it is not necessary to provide an interface for connecting the gate 17 to a valve (not shown) for distributing the recirculated exhaust gases into the gate 17, as is required in the prior art solutions for metering the quantity of recirculated exhaust gases to be introduced into the distribution duct 13.

In fact, such a valve is not obligatory because the flow of recirculated exhaust gases to be injected into the flow of charge air can be metered directly by the distribution device 11.

Figure 5:
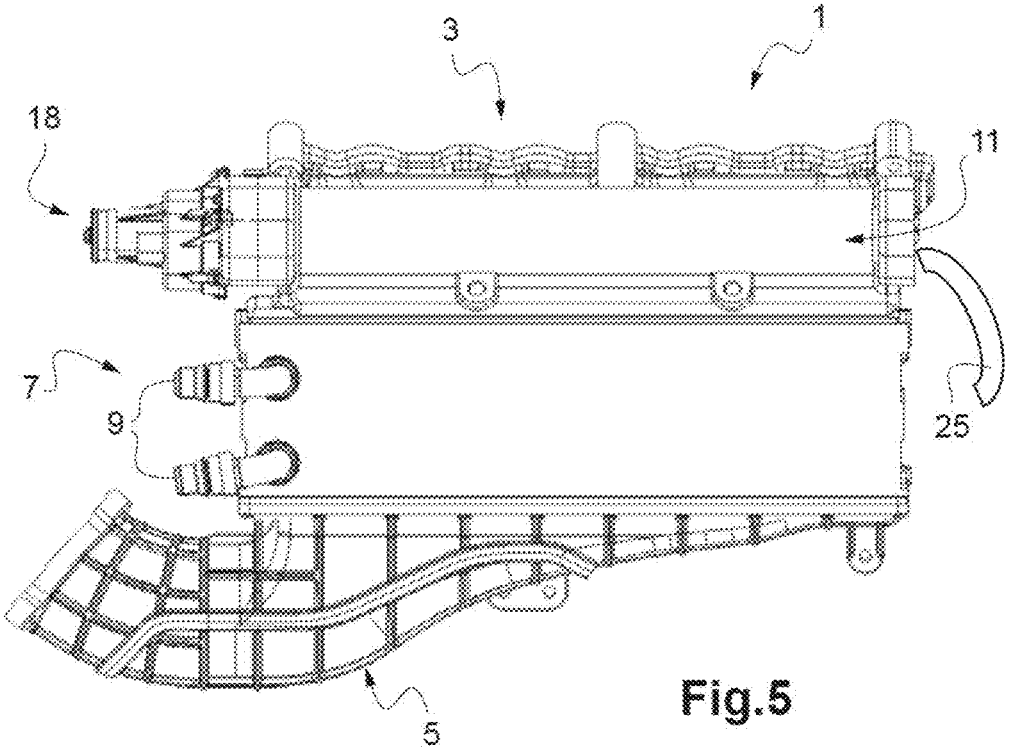
FIG. 5 is a view of the inlet module representing diagrammatically the fluidic connection between the rotary control member and a recirculated exhaust gases routing pipe.

Accordingly, as represented in a simplified and diagrammatic manner in FIG. 5, the distribution device 11 may be connected directly to a pipe 25 for routing exhaust gases recovered at the engine outlet.

The invention claimed is:

1. An air inlet module configured to supply at least one internal combustion engine cylinder with a flow of air containing inlet gases and/or recirculated exhaust gases (EGR) wherein the air inlet module contains:

a heat exchanger configured to condition the flow of air, and an inlet manifold configured to supply at least one cylinder of the engine, arranged downstream of the heat exchanger in the direction of flow of the flow of air in the inlet module, and wherein said air inlet module comprises at least one recirculated exhaust gases distribution device of the inlet manifold, the distribution device including: a recirculated exhaust gases distribution duct, wherein the distribution duct includes first means for injection of recirculated exhaust gases into the flow of air for supplying the at least one cylinder, and wherein the distribution device further includes a control member that is arranged in the distribution duct and is configured to modulate the flow of recirculated exhaust gases injected by the first means;

said recirculated exhaust gases distribution device is arranged downstream of the heat exchanger on a part of the upstream side of the inlet manifold, relative to the direction of flow of the flow of air in the air inlet module.

2. The module as claimed in claim 1, wherein the control member is a rotary control member configured to modulate the recirculated exhaust gases flow as a function of the angular position of the rotary control member.

3. The module as claimed in claim 2, wherein the first means include at least one first injection hole and wherein the control member is conformed so as to adjust the dimensions of the first injection hole.

4. The module as claimed in claim 1, wherein the control member is mobile in translation.

5. The module as claimed in claim 4, wherein the first means include at least one first injection hole and wherein the control member is conformed so as to adjust the dimensions of the first injection hole.

6. The module as claimed in claim 1, wherein the first means include at least one first injection hole and wherein the control member is conformed so as to adjust the dimensions of the first injection hole.

7. The module as claimed in claim 1, wherein: the control member includes second recirculated exhaust gases injection means including at least one second injection hole, and the control member is adapted to be arranged in a position allowing fluidic communication to be established between a first injection hole and an associated second injection hole.

8. The module as claimed in claim 7, wherein the number of second injection holes of the control member is the same as the number of first injection holes.

9. The module as claimed in claim 1, wherein the distribution duct and/or the control member is/are adapted to be arranged substantially transversely relative to the flow of the flow of air in the inlet module.

10. The module as claimed in claim 1, wherein the control member takes the form of a substantially cylindrical tube.

11. The module as claimed in claim 1, including at least one return means adapted to urge the control member toward a predefined safety position.

* * * * *